US005343125A

United States Patent [19]

Bernitz et al.

[11] Patent Number: 5,343,125

[45] Date of Patent: Aug. 30, 1994

[54] HIGH-PRESSURE DISCHARGE LAMP WITH PULSED INVERTER OPERATING CIRCUIT, AND METHOD OF OPERATING A DISCHARGE LAMP

[75] Inventors: Franz Bernitz, Unterhaching; Andreas Huber, Maisach; Frank Hansmann, Barsinghausen, all of Fed. Rep. of Germany

[73] Assignee: Patent-Treuhand-Gesellschaft feur elektrische Gluehlampen mbH, Munich, Fed. Rep. of Germany

[21] Appl. No.: 786,502

[22] Filed: Nov. 1, 1991

[30] Foreign Application Priority Data

Nov. 15, 1990 [DE] Fed. Rep. of Germany ... 9015674[U]

[51] Int. Cl.[5] ..... H05B 41/36

[52] U.S. Cl. ..... 315/245; 315/241 R; 315/243; 315/DIG. 7

[58] Field of Search ..... 315/241 R, 245, DIG. 7, 315/243

[56] References Cited

U.S. PATENT DOCUMENTS

| | | | |
|---|---|---|---|
| 3,777,212 | 12/1973 | Mashimo | 315/241 R X |
| 4,647,817 | 3/1987 | Fähnrich et al. | 315/245 X |
| 4,730,147 | 3/1988 | Kroening | 315/DIG. 7 X |
| 4,792,887 | 12/1988 | Bernitz et al. | 363/89 |
| 4,866,347 | 9/1989 | Huckolls et al. | 315/DIG. 7 X |
| 4,904,907 | 2/1990 | Allison et al. | 315/DIG. 7 X |
| 4,914,356 | 4/1990 | Cockram | 315/DIG. 7 X |
| 5,047,695 | 9/1991 | Allen et al. | 315/DIG. 7 X |
| 5,059,867 | 10/1991 | Herone et al. | 315/DIG. 7 X |

FOREIGN PATENT DOCUMENTS

| | | |
|---|---|---|
| 0059053 | 9/1982 | European Pat. Off. . |
| 0256231 | 2/1988 | European Pat. Off. . |
| 2383576 | 10/1978 | France . |
| 2489069 | 2/1982 | France . |

OTHER PUBLICATIONS

"Zundung von Halogen-Metalldampfanlagen" (Ignition of Metal Halide Vapor Lamps) by H.-J. Fahnrich and H. Leyendecker, Fernsch-und Kino-Technik (Television and Motion Picture Technology) 1972, No. 8, pp. 279-282.

*Primary Examiner*—D. Hyun Yoo

*Attorney, Agent, or Firm*—Frishauf, Holtz, Goodman & Woodward

[57] ABSTRACT

To ensure ignition of a high-pressure discharge lamp, for example a metal vapor halogen high-pressure discharge lamp which has an ignition circuit, and is operated by direct current from an inverter circuit controlled for pulse width modulation, current flow to the lamp is extended in time upon initial energization thereof so that an initial hot spot which forms on an electrode can remain hot to establish a stabilized arc. This extension of current flow can be obtained by an R/C circuit in parallel to the output or storage capacitor ($C_A$) of the inverter circuit (FIG. 1) or by an NTC resistor (H) in series with the lamp, or by a resistor which is short-circuited by a relay contact as the lamp operates, or the like.

18 Claims, 3 Drawing Sheets

HIGH-PRESSURE DISCHARGE LAMP WITH PULSED INVERTER OPERATING CIRCUIT, AND METHOD OF OPERATING A DISCHARGE LAMP

Reference to related patent, the disclosure of which is hereby incorporated by reference, assigned to the assignee of the present application:

U.S. Pat. No. 4,792,887, Bernitz et al. Reference to related literature: "Zündung von Halogen-Metalldampfanlagen" (Ignition of Metal Halide Vapor Lamps") by H. -J. Fähnrich and H. Leyendecker, Fernseh- und Kino-Technik ("Television and Motion Picture Technology"), 1972, No. 8, p. 279.

FIELD OF THE INVENTION

The present invention relates to a power supply circuit, which includes an inverter to operate a discharge lamp, and more particularly to such a circuit which ensures rapid ignition of the lamp upon energization thereof, so that the circuit, and the lamp, can be used for automotive head lamps; high-pressure discharge lamps of low power consumption, for example in the order of about 25 to 50 W, and especially of about 35 W, are suitable for this purpose, if they can start reliably and rapidly.

BACKGROUND

An electronic accessory apparatus for a discharge lamp which includes a control circuit for a switching transistor is described in the referenced U.S. Pat. No. 4,792,887, Bernitz et al, assigned to the assignee of the present application, the disclosure of which is hereby incorporated by reference. The Bernitz patent, especially, describes a switching circuit to control a switching transistor which oscillates between conductive and non-conductive state, to provide operating energy at a suitable voltage to a discharge lamp. The energy is supplied through a diode, so that the discharge lamp receives the energy in form of direct current which has a small alternating component superimposed thereon.

It has been found that when small power high-pressure discharge lamps are coupled to circuits of this type, which use a capacitor at the output of the auxiliary circuit, problems with ignition of the lamp may arise. The capacitor at the output of the circuit provides energy to the lamp during the time when no energy is available directly from the power supply network. In the particular circuit, this is the case when a cross-connected semiconductor is conductive. The capacity value of this capacitor must be selected to be sufficiently large that it can supply current to the discharge lamp with only a small a-c component, derived from the switching frequency of the semiconductor, so that the lamp does not extinguish when no current is being supplied, due to the rectification, typically by a diode, from the oscillating semiconductor. The capacity value of this capacitor must be small enough, however, so that the voltage at the capacitor can rise rapidly enough in view of the switching frequency, and duty cycle of the inverter circuit. Both requirements—sufficient energy supply and sufficient energy storage capacity—can be met by an output capacitor. Upon initial ignition, however, the pulsed, rapid discharge of the relatively small capacitor, which may, for example, have a capacity value in the order of only several micro farads, may cause problems, since the duration of the discharge current from the output capacitor may not be long enough to ensure transition of the high-pressure discharge lamp into a stable arc discharge.

THE INVENTION

It is an object to improve an accessory circuit, and particularly an inverter circuit, for a high-pressure discharge lamp, particularly of low power, which provides trouble-free operation and excellent ignition of the lamp upon initial energization thereof.

Briefly, a conventional power supply circuit, including an inverter with a storage capacitor connected in parallel to the lamp, includes an additional circuit to ensure starting of ignition of the lamp upon initial energization. This additional circuit is coupled to the lamp and extends the current flow to the lamp from the storage capacitor upon initial energization. The circuit may, for example, be an additional resistor-capacitor (R/C) circuit, a negative-temperature coefficient (NTC) resistor, a relay connected to short-circuit a resistor, or the like.

In accordance with a feature of the invention, the lamp, under continuous conditions, is operated in accordance with well known operating criteria; under starting conditions, however, the initial current pulse applied to the lamp is extended in time. While the intensity of the current pulse, initially, may be reduced, the extension of time of current flow ensures that the arc within the high-pressure discharge lamp will start reliably.

Placing an R/C element of relatively long time constant in parallel to the output capacitor ensures that a small, but continuously enduring discharge current will flow from the capacitor of the R/C element to the lamp. This current, in combination with the relatively high but only short discharge current from the output capacitor, ensures starting of the arc and maintenance of the arc, once the ignition has begun. Rather than using an R/C element in parallel to the output capacitor, a resistor circuit or resistance element which changes resistance, with respect to time, can be connected in series with the lamp. Such a resistor can be formed by a hot-conductive resistor, also known as an NTC resistor, or a thermistor; or it may be formed by a parallel circuit of a resistor with a mechanical relay contact which, after current flow has been established, short-circuits the resistor. The resistor in combination with the capacitor discharge from the storage capacitor extends the time of discharge.

At the instant of ignition the resistor, whether a resistor not yet shunted by a relay contact, or of high resistance value if an NTC resistor, prevents rapid discharge of the output capacitor, so that the discharge current cannot decay fast. Upon heating, if an NTC resistor is used, or after time, closing of the relay contact and thus short-circuiting a resistor, an increased current flow will obtain and thus ensure reliable starting of the lamp.

The ignition characteristics of high-pressure discharge lamps have been investigated; upon ignition, the output capacitor delivers a high discharge current in the order of about 50 A during the brief time span of about 3 micro seconds. This high current generates a hot spot on the electrodes of the lamp. This is not sufficient, however, in order to change the state of the lamp to complete arc-over as the ignition pulse decays, that is, to transfer the state of the lamp into an arc discharge at all times. A current which decays slowly, such as the smaller discharge current of the capacitor of the C/R network, which may be initially only about 5 A, together with the discharge current from the output capacitor, however, ensures reliable ignition of the lamp, since continuous heating after the first hot spot is generated, will obtain. Likewise, by suitably dimensioning of the output capacitor, an extended pulse of sufficient energy can be obtained when using a serially connected circuit, the resistance of which varies with respect to time.

DRAWINGS

FIG. 1 illustrates the circuit of the present invention using an electronic starter and accessory apparatus with an R/C circuit;

FIG. 2*a* illustrates the system of FIG. 1 with an NTC resistor; and

FIG. 2*b* illustrates the system of FIG. 1 with a parallel circuit of a resistor with a mechanical relay contact which is triggered by the control circuit (S).

DETAILED DESCRIPTION

Figure 1:
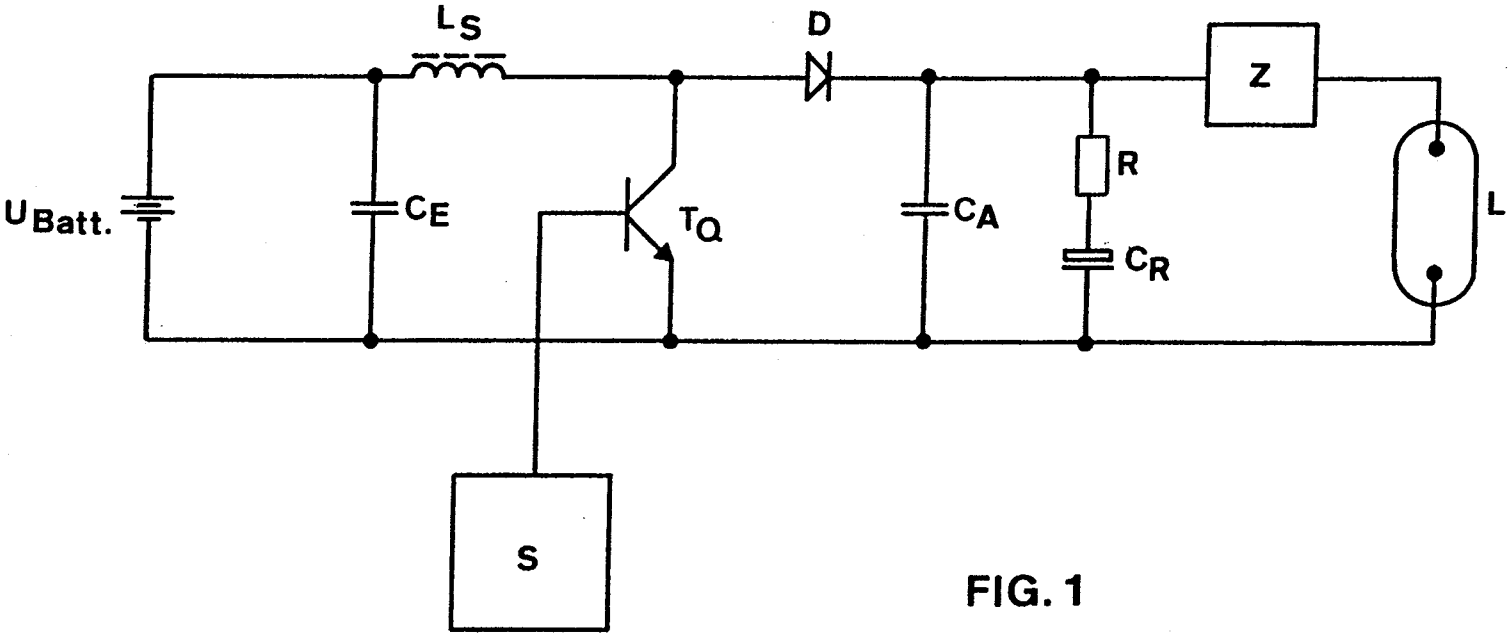

FIG. 1 illustrates the general structure of an electronic starter, ballast or accessory circuit for a 35 watt halogen metal vapor high-pressure discharge lamp L, for use with a direct current source, for example an automotive battery $U_{Batt}$. The circuit has primary applicability for low power lamps, e.g. in the approximate range of from 25–50 W. The system uses an ignition circuit Z. Lamps and starter circuits of this type can be used in automotive headlights. The circuit includes a secondary oscillating inverter booster circuit using a choke $L_S$. Such circuits are also known as boost converter circuit S. The control circuit S does not form part of the present invention, and, therefore, is shown only schematically. The referenced U.S. Pat. No. 4,792,887, Bernitz et al illustrates one form of such a control circuit. Other control circuits may be used. The energy source $U_{Batt}$ is a 12 volt motor vehicle battery. Parallel to the d-c input, an input capacitor $C_E$ is connected. This capacitor has a high capacitance. The switching transistor $T_Q$, preferably, is a power MOSFET. The gate voltage of the transistor $T_Q$ is controlled with a frequency of between about 20–75 kHz. The choke $L_S$ and the diode D, as well as an output capacitor $C_A$ form part of the boost converter circuit.

In accordance with a feature of the present invention, an R/C circuit is connected in parallel to the output capacitor, which is the charge or storage capacitor $C_A$. The capacity of the capacitor $C_R$ is high with respect to that of the output storage capacitor $C_A$.

The high-pressure discharge lamp L, typically a 35 watt discharge lamp, is connected in series with the ignition circuit Z, and, with the circuit Z, parallel to the storage capacitor $C_A$ and the R/C element. The ignition circuit Z is well known, and various such ignition circuits are described in the referenced article "Züdung von Halogen-Metalldampfanlagen" ("Ignition of Metal Halide Vapor Lamps") by H. -J. Fähnrich and H. Leyendecker, Fernseh- und Kino-Technik ("Television and Motion Pictur Technology"), 1972, No. 8, page 279.

Typical values of the circuits are:
battery $U_{Batt}$: 12 V
capacitor $C_E$: 5000 μF
choke $L_S$: 0.5 mH
output capacitor $C_A$: 3.3 μF.
Capacitor $C_R$: 22 μF
resistor R: 33 ohms.
Operation When the transistor $T_Q$ is controlled to conduction from the control circuit S, the power circuit, with the lamp L, is completely separated from the battery due to the diode D. The circuit formed by the battery, choke $L_S$ and transistor $T_Q$ thus is isolated from the lamp L. Energy supply to the lamp during this conductive phase of the transistor $T_Q$ is provided primarily by the previous charge on the output capacitor $C_A$.

At the next phase, and when the transistor $T_Q$ blocks, the battery and the choke $L_S$ provide voltage supply to the discharge lamp L. At this phase of operation, capacitors $C_A$ and, in accordance with the invention, $C_R$, are charged to the output voltage derived from the battery, as boosted by the choke $L_S$. The control circuit controls the output voltage of the supply circuit by control of the frequency and duty cycle of the transistor $T_Q$ to the lamp operating voltage of about 100 V.

The R/C circuit is used only as an assistance to ignition.

During ignition of the discharge lamp, the output capacitor $C_A$ of, for example, about 3.3 μF, provides a high discharge current in the order of about 50 A for an extremely short period of time, about 3 micro seconds, which generates a hot spot on the lamp electrodes. This hot spot is not sufficient, however, in order to change lamp operation, after the ignition impulse, into a stable arc discharge. The relatively small discharge current derived from the capacitor $C_R$, however, which has an initial value of about 5 A, permits, together with the discharge current of the output capacitor $C_A$, reliable ignition of the lamp by extending current flow to the lamp.

Figure 2A:
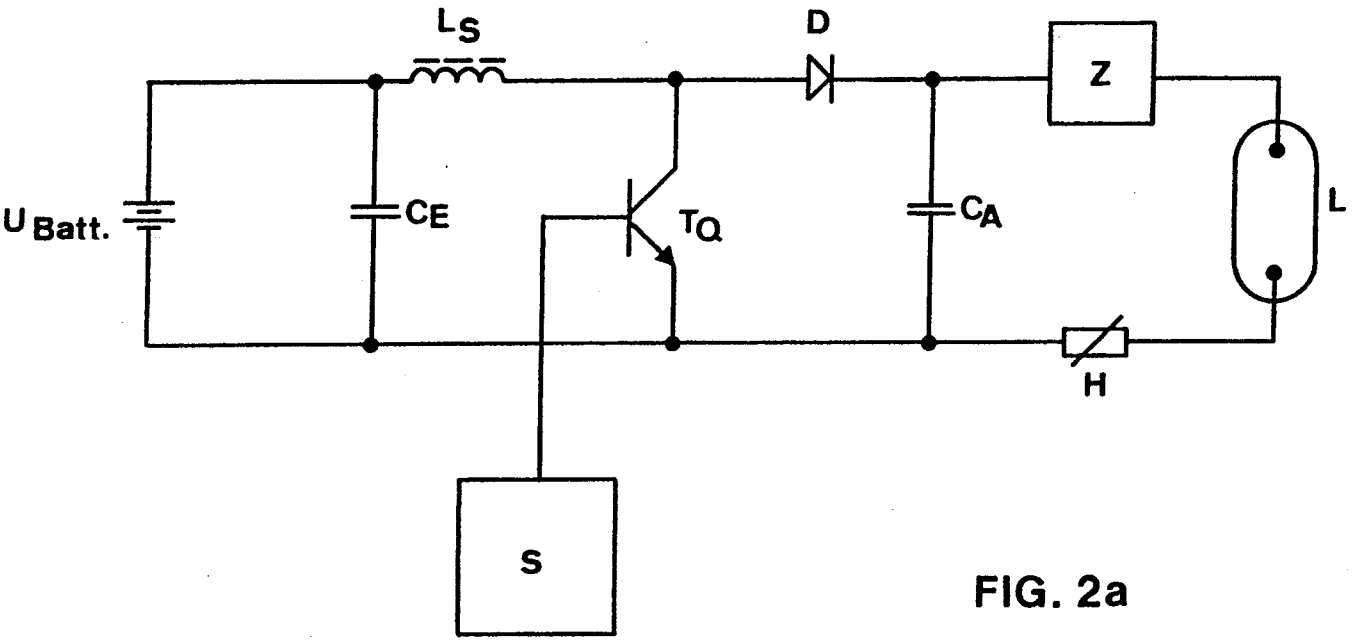
Figure 2B:
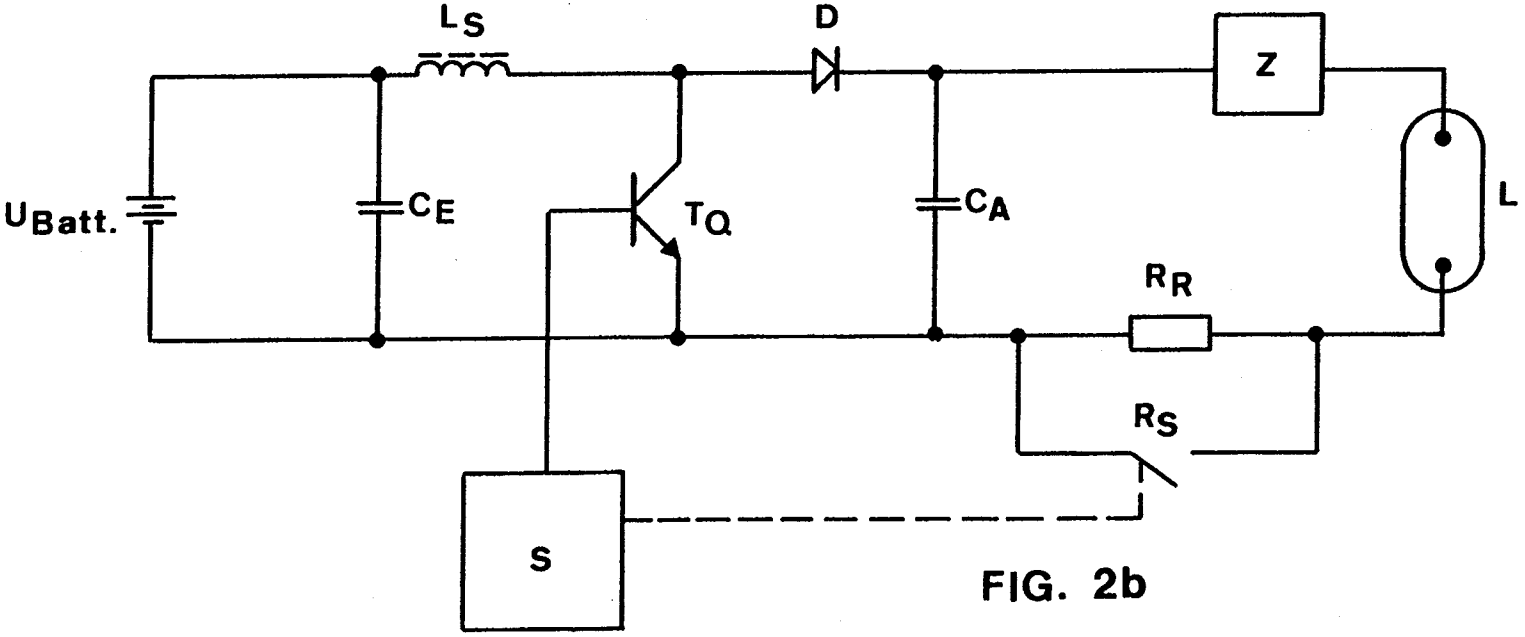

The system of FIG. 2 is basically identical to that of FIG. 1. The lamp L, again, is a 35 W metal vapor halogen high-pressure discharge lamp. In accordance with a feature of the invention, however, rather than using an R/C circuit to extend the time of current flow to the lamp L, a hot conductor or NTC resistor H is connected in series to the lamp L. Thus, the current upon discharge of the capacitor $C_A$ first has to flow through the high resistance of the NTC resistor H and, upon continued current flow, the resistor will heat and its resistance will drop to a low level. The initial high resistance, however, in effect, together with the capacitor $C_A$ forms a resistor-capacitor circuit.

A suitable value for the NTC resistor is 10 ohms.

Other circuits may be used to extend the time of current flow upon ignition. For example, rather than using an NTC resistor H, a relay having a relay coil RL (not shown) is controlled by and part of the control circuit S, to close its switch contact $R_S$, thus short-circuiting a resistor RR, and hence the lamp L. Again, initially, the relay-shunted resistor RR, together with capacitor $C_A$, forms an R/C circuit which extends the time of discharge of the capacitor $C_A$.

Various other circuits may be used, and the invention is not restricted to the particular boost converter circuits shown. For example, a flyback converter, which is isolated or non-isolated, may be used; likewise, a buck converter circuit may be used.

Various other changes and modifications may be made, and any features described herein may be used with any of the others, within the scope of the inventive concept.

The values for an illustrative circuit are not critical. The output storage capacitor $C_A$, for example, may have a capacity value of between 0.01 μF and 25 μF; the capacitor of the R/C element may have a capacity of between 0.5 μF and 25 μF, approximately, and the resistor R of the R/C circuit may have a resistance between 10 ohms and 100 ohms. The NTC resistor H may have a cold resistance for example of between 10 and 100 ohms. The relay RS may close based on time after initial energization, or current flow through the relay coil RL.

We claim:

1. A power supply circuit for a discharge lamp (L) comprising an inverter forming an inverter energy supply circuit for said lamp (L) and being connected between a d-c power supply source and said lamp, said inverter energy supply circuit including means (S) for providing an oscillating switching control signal;

a switching semiconductor ($T_Q$);

energy storage means ($L_S$, $C_A$); and a rectifier means (D), said switching semiconductor ($T_Q$) being controlled by said switching control signal providing means (S) for alternatingly changing between conductive and blocking state, and wherein said energy storage means includes a storage capacitor ($C_A$) connected for providing operating current to said lamp (L) when the rectifier means (D) blocks current flow to the lamp (L) in a direction that would discharge said storage capacitor and having a first terminal connected to said rectifier means and a second terminal connected directly to said lamp;

circuit means comprising a said power supply circuit further comprising series resistor/capacitor ($R/C_R$) circuit connected in parallel to said storage capacitor ($C_A$) for ensuring starting of ignition of the lamp upon initial energization of said inverter, whereby said starting ensuring circuit means, being coupled to said lamp, extends the time of current flow to said lamp after initial current flow from said storage capacitor ($C_A$) to said lamp upon initial energization of the inverter.

2. The power supply circuit of claim 1, wherein said storage capacitor ($C_A$) has a capacity of between 0.01 μF to about 25 μF.

3. The power supply circuit of claim 1, wherein the capacitor ($C_R$) in the starting ensuring circuit means has a capacity of between about 0.5 μF to 25 μF.

4. The power supply circuit of claim 1, wherein the resistance of the resistor (R) of the starting ensuring circuit means has a value of between 10 ohms to 100 ohms.

5. The power supply circuit of claim 1, wherein said lamp comprises a halogen metal vapor high-pressure discharge lamp.

6. The power supply circuit of claim 5, wherein said halogen metal vapor high-pressure discharge lamp is a lower-power lamp having a power rating in the order of about 25–50 W.

7. The power supply circuit of claim 5, wherein said halogen metal vapor high-pressure discharge lamp has a power rating in the order of about 35 W.

8. A power supply circuit for a discharge lamp (L) comprising an inverter forming an inverter energy supply circuit for said lamp (L) and being connected between a d-c power supply source and said lamp, said inverter energy supply circuit including means (S) for providing an oscillating switching control signal;

a switching semiconductor ($T_Q$);

energy storage means ($L_S$, $C_A$); and a rectifier means (D) having a first terminal connected to a first terminal of said switching semiconductor, said switching semiconductor ($T_Q$) being controlled by said switching control signal providing means (S) for alternatingly changing between conductive and blocking state, and wherein said energy storage means includes a storage capacitor (C) connected directly between a second terminal of said rectifier means and a second terminal of said switching semiconductor for providing operating current to said lamp (L) when the rectifier means (D) blocks current flow to the lamp (L) in a direction that would discharge said storage capacitor;

said power supply circuit further including an ignition circuit (Z) connected directly both to said lamp (L) and to a first terminal of said storage capacitor ($C_A$);

and circuit means comprising negative temperature coefficient (NTC) resistor connected directly between said second terminal of said switching semiconductor and said lamp (L) for ensuring starting of ignition of the lamp upon initial energization of said inverter whereby said starting ensuring circuit means, coupled to said lamp, extends the time of current flow to said lamp after initial current flow from said storage capacitor ($C_A$) to said lamp upon initial energization of the inverter.

9. The power supply circuit of claim 8, wherein said storage capacitor ($C_A$) has a capacity of between 0.01 μF to about 25 μF.

10. The power supply circuit of claim 8, wherein said negative temperature coefficient (NTC) resistor has a cold resistance of between about 10 and 100 ohms.

11. The power supply circuit of claim 8, wherein said lamp comprises a halogen metal vapor high-pressure discharge lamp.

12. The power supply circuit of claim 11, wherein said halogen metal vapor high-pressure discharge lamp is a low-power lamp having a power rating in the order of about 25–50 W.

13. The power supply circuit of claim 11, wherein said halogen metal vapor high-pressure discharge lamp has a power rating in the order of about 35 W.

14. A power supply circuit for a discharge lamp (L) comprising an inverter forming an inverter energy supply circuit for said lamp (L) and being connected between a d-c power supply source and said lamp, said inverter energy supply circuit including means (S) for providing an oscillating switching control signal;

a switching semiconductor ($T_Q$); energy storage means ($L_S$, $C_A$); and a rectifier means (D) having a first terminal connected to a first terminal of said switching semiconductor, said switching semiconductor ($T_Q$) being controlled by said switching control signal providing means (S) for alternatingly changing between conductive and blocking state, and wherein said energy storage means includes a storage capacitor ($C_A$) connected directly between a second terminal of said rectifier means and a second terminal of said switching semiconductor for providing operating current to said lamp (L) when the rectifier means (D) blocks current flow to the lamp (L) in a direction that would discharge said storage capacitor said power supply circuit further comprising;

an ignition circuit (Z) connected directly both to said lamp (L) and to a first terminal of said storage capacitor ($C_A$);

and circuit means comprising a resistor ($R_R$) of substantial fixed value connected directly between said second terminal of said switching semiconductor and said lamp (L) for ensuring starting ignition of the lamp upon initial energization of said inverter and a relay switch ($R_S$) connected in parallel with said resistor, said relay switch being controlled by said switching control signal providing means (S) to apply a conductor in shunt with said resistor after elapse of a predetermined interval after energization of said resistor.

15. The power supply circuit of claim 14, wherein said storage capacitor ($C_A$) has a capacity of between 0.01 $\mu$F to about 25 $\mu$F.

16. The power supply circuit of claim 14, wherein said lamp comprises a halogen metal vapor high-pressure discharge lamp.

17. The power supply circuit of claim 16, wherein said halogen metal vapor high-pressure discharge lamp is a low-power lamp having a power rating in the order of about 25–50 W.

18. The power supply circuit of claim 16, wherein said halogen metal vapor high-pressure discharge lamp has a power rating in the order of about 35 W.

* * * * *

UNITED STATES PATENT AND TRADEMARK OFFICE

CERTIFICATE OF CORRECTION

PATENT NO. : 5,343,125

DATED : August 30, 1994

INVENTOR(S) : BERNITZ et al.

It is certified that error appears in the above-indentified patent and that said Letters Patent is hereby corrected as shown below:

Column 5, claim 1 should read as follows:

A power supply circuit for a discharge lamp (L) comprising an inverter forming an inverter energy supply circuit for said lamp (L) and being connected between a d-c power supply source and said lamp, said inverter energy supply circuit including means (s) for providing an oscillating switching control signal;

a switching semiconductor ($T_Q$), and a rectifier means (D) having a first terminal connected to a first terminal of said switching semiconductor; energy storage means comprising an inductor ($L_S$) and a storage capacitor ($C_A$), said inductor having a first terminal connected to a first terminal of said d.c. power supply source and a second terminal connected to a first terminal of said rectifier means, said rectifier means having a second terminal connected to a first terminal of said storage capacitor; a second terminal of said storage capacitor being connected both to a second terminal of said d.c. power supply source and to a terminal of said lamp (L);

--

UNITED STATES PATENT AND TRADEMARK OFFICE

CERTIFICATE OF CORRECTION

PATENT NO. :5,343,125

DATED :August 30, 1994

INVENTOR(S) :BERNITZ et al.

It is certified that error appears in the above-indentified patent and that said Letters Patent is hereby corrected as shown below:

said switching semiconductor ($T_Q$) being controlled by said switching control signal providing means (S) for alternatingly changing between conductive and blocking states, said switching semiconductor ($T_Q$) energizing said inductor ($L_S$) during said conducting state of said switching semiconductor, while said rectifier means prevents discharge of said storage capacitor through said switching semiconductor, whereas said blocking state of said switching semiconductor allows said inductor ($L_S$) to charge said storage capacitor ($C_A$) through said rectifier means (D), said first terminal of said storage capacitor ($C_A$) being connected for providing current to said lamp (L), and circuit means, comprising a series resistor/capacitor ($R/C_R$) circuit connected in parallel to said storage capacitor ($C_A$), for ensuring starting of ignition of the lamp upon initial energization of said inverter, whereby said circuit means for ensuring starting of ignition, as a result of being coupled to said lamp, extends the time of current flow to said lamp after each maximum of current flow from said storage capacitor ($C_A$) to said lamp produced in each charging cycle of said storage capacitor by said inductor.

Signed and Sealed this

Sixteenth Day of September, 1997

*Attest:*

Bruce Lehman

BRUCE LEHMAN

*Attesting Officer*

*Commissioner of Patents and Trademarks*